United States Patent [19]

Saunders

[11] 4,283,829

[45] Aug. 18, 1981

[54] PROTECTIVE DEVICE FOR MOUNTING BLADES ON ARROWHEAD

[75] Inventor: Charles A. Saunders, Columbus, Nebr.

[73] Assignee: Saunders Archery Company, Columbus, Nebr.

[21] Appl. No.: 38,495

[22] Filed: May 14, 1979

[51] Int. Cl.[3] ..... B25B 27/14

[52] U.S. Cl. ..... 29/278

[58] Field of Search ..... 29/278; 81/121 R, 121 A, 81/121 B, 90

[56] References Cited

U.S. PATENT DOCUMENTS

| | | | |
|---|---|---|---|
| 2,631,482 | 3/1953 | Rinehart | 81/3.4 |
| 2,966,083 | 12/1960 | Cheney | 81/120 |

FOREIGN PATENT DOCUMENTS

| | | | |
|---|---|---|---|
| 808 | of 1893 | United Kingdom | 81/120 |

*Primary Examiner*—James L. Jones, Jr.

*Attorney, Agent, or Firm*—Kegan, Kegan & Berkman

[57] ABSTRACT

A spool-like protective device facilitates the mounting of a plurality of razor-sharp broadhead blades on an arrowhead while protecting a user's hands from being cut by the blades. The body of the device includes a tapered central bore adapted to receive an arrowhead and an array of blade receiving slots extending radially from the central bore and aligned in conventional evenly arcuately spaced orientation for receiving three and four blade or more broadhead arrows. Further, at least one side wall of each slot includes a protuberance extending therefrom into the slot forming a surface for frictionally engaging a blade positioned in the slot to prevent undesired movement of a blade once it is substantially inserted therein. An outer generally cylindrical surface on the body is adapted for being grasped by a user to facilitate handling and rotation of the arrowhead when manipulating the blades thereof while maintaining the user's finger's a safe distance from the razor-sharp blade edges.

7 Claims, 9 Drawing Figures

PROTECTIVE DEVICE FOR MOUNTING BLADES ON ARROWHEAD

BACKGROUND OF THE INVENTION

This invention relates to a device for efficiently mounting razor-sharp removable blades in an arrowhead and, more particularly, this invention relates to a device for protecting the hands of a user while facilitating the insertion of a plurality of razor-sharp blades on a broadhead arrow and maintaining the blades thereon until a retainer on the arrow locks the blades in position.

Typical broadhead arrows used by archers for hunting purposes include a multi-piece arrowhead having a conical steel tip, an aluminum spindle or head fixedly positioned rearwardly of the tip and having a plurality of blade receiving grooves extending axially therealong in equally spaced arcuate orientation for receiving blades therein. With one type of arrowhead, at the tip end of the spindle the groove extends partway under a skirt at the base of the tip so that the front end of a blade is capable of being retained thereby. At the rear of the spindle, a retainer is threadedly engaged in a central bore in the spindle and also includes a hollow skirt capable of retaining a trailing edge of a blade when same is positioned in a spindle groove. The blades are elongate and substantially triangular in shape and have a leading or outside edge which is razor-sharp. Conventional broadhead arrows are adapted to have either three, or four, or six such removable blades mounted thereon in evenly arcuately spaced relation therearound so as to radially extend from the spindle. In the field, the razor-sharp blades are inserted in the grooves one at a time around the spindle. However, since the skirt on the retainer engages the trailing edges of all of the blades simultaneously, each blade must be retained in mounted position in its groove as the remainder of the blades are positioned in their respective grooves prior to tightening the retainer thereon. Heretofore, the most convenient and practical retainer has been a user's hand, preferably protected by the use of a glove, cloth or the like. The risk of cutting one's self on the razor-sharp blade edges has been readily apparent.

With other types of broadhead arrows, for example, where each blade is retained in its respective groove by an annular retaining spring, the protective device facilitates safe rotation of the arrowhead with a user's hands, both for inserting individual blades, and for threading the arrowhead onto the arrow shaft.

It is therefore an object of the present invention, generally stated, to provide a protective device for facilitating the insertion of razor-sharp broadhead blades in an arrowhead and maintaining same in position until they are secured thereon while protecting the archer's hand from being cut by the blade edges.

A further object of the present invention is the provision of means in the protective device for allowing movement of the razor-sharp blades to a position wherein they are mounted on the arrowhead while frictionally restraining other undesirable movement of the blades, particularly when the blades are loosed from a user's hands.

SUMMARY OF THE INVENTION

This invention relates to a hand-held protective device which facilitates the safe loading of blade elements into an arrowhead. The device includes a spool-like body formed with a principal central bore extending axially therein, and an array of blade receiving slots formed in the body which communicate with and radially extend from the central bore at selectable arcuate spacings therearound. The slots also extend axially along the length of the bore.

BRIEF DESCRIPTION OF THE DRAWINGS

The features of the present invention, which are believed to be novel, are set forth with particularity in the appended claims. This invention may best be understood by reference to the following description of presently preferred embodiments thereof taken in conjunction with the accompanying sheet of drawings in the several figures of which like reference numerals identify like elements, and in which:

DETAILED DESCRIPTION OF THE PREFERRED EMBODIMENTS

Figure 1:
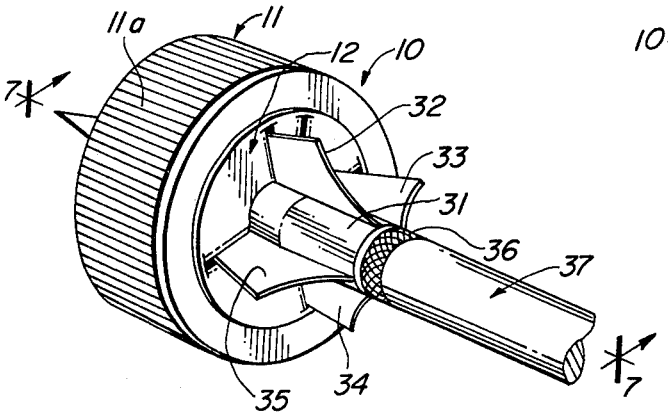
FIG. 1 is a perspective view of the protective device of the present invention shown with a fully assembled head of a broadhead arrow inserted therein.
Figure 2:
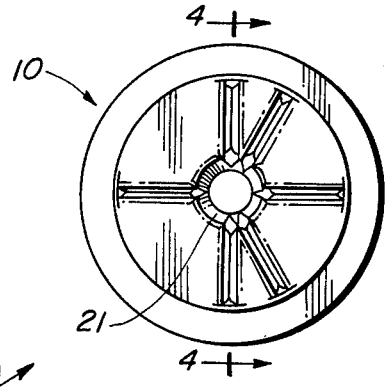
FIG. 2 is a detail elevational view of the front of the protective device shown in FIG. 1.
Figure 3:
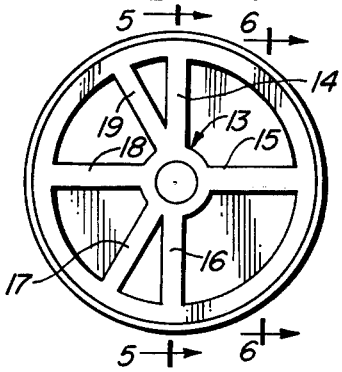
FIG. 3 is a detail elevational view of the rear of the protective device shown in FIG. 1.

Referring to FIG. 1, the protective device constructed in accordance with the present invention is defined by a spool-like body, generally indicated at 10, preferably made of molded plastic, having portions thereof hollowed-out to produce a light weight, low cost structure. The body includes a generally annular outer ring 11, which preferably includes ribs 11*a* for ease of grasping by a user, and a face 12 extending across the front of the annular ring 11 and generally flush with one end thereof. Referring to FIG. 3, the body 10 further includes a hollow central hub 13 extending the length of the annular ring 11 coaxially therewith and positioned in communication with the front face 12. Annular hub 13 is further supported by a plurality of hollow spoke-like struts 14–19 extending between and in communication with the interior of the outer annular ring 11 and the central hub 13, and similarly to the hub, extending the length of the outer annular ring and being in communication with the front face 12. Projections 14, 15, 16 and 18 are positioned at evenly spaced 90° intervals around the hub 13. Projections 17 and 19 are positioned 120° each in opposing directions from projection 15. The orientation of the respective four-spoke and three-spoke symmetrical groupings correspond to the evenly spaced orientations of three-blade and four-blade broadhead arrows, respectively. It will be understood the other blade orientations may also be accommodated within the scope of the invention.

Referring to FIGS. 2, 4, 5, and 6, the hollow center of hub 13 is defined by a tapered bore 21 which extends axially through hub 13 in communication with the front face 12 and tending to converge as the bore extends along hub 13 inwardly from the front face.

Figure 4:
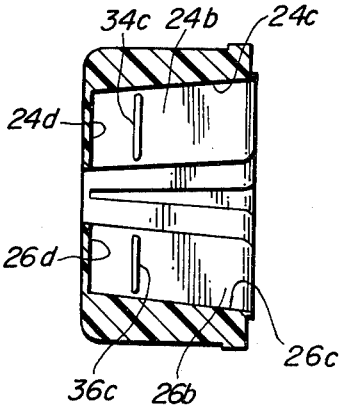
FIG. 4 is a cross-sectional view taken substantially along lines 4—4 of FIG. 2.
Figure 5:
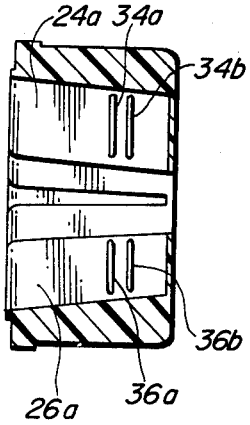
FIG. 5 is a cross-sectional view taken substantially along lines 5—5 of FIG. 3.
Figure 6:
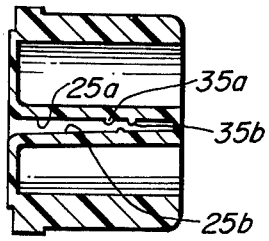
FIG. 6 is a cross-sectional view taken substantially along lines 6—6 of FIG. 3.

As shown most clearly in FIGS. 4, 5, and 6, the hollow portion of spoke-like struts 14 and 16 includes opposed, slightly spatially related, tapered side walls 24*a* and 24*b*; 26*a* and 26*b*, respectively, and a tapered end wall 24*c* and 26*c*, respectively, extending between and connecting the radially outwardmost edges of each pair of side walls. Each pair of tapered side walls 24*a*, 24*b*, 26*a*, and 26*b*, respectively, converges toward the rear of the respective projections preferably defining a thin bottom wall 24*d* and 26*d*, respectively, for each of the hollow areas. The innermost portions of the side walls defined by the subletters a, b, c and d are in communication with the central bore 21, thus defining a plurality of the tapered slots 24 and 26 shown with one such slot position in each spoke-like strut. The corresponding slots 15, 17, 18 and 19 include like structures.

Each slot side wall 24*a* and 26*a* shown includes a plurality of (in this embodiment 2) bar-like protuberances 34*a* and 34*b*, 36*a* and 36*b*, respectively, which protrude from the side wall into the slot and extend radially substantially across the width of each slot. The opposing side walls 24*b* and 26*b* each include a single bar-like protuberance 34*c* and 36*c*, respectively, which also extends into the slot from the side wall and is positioned radially across the width thereof. Additionally, each protuberance 34*c* and 36*c* is positioned to extend into the space between the opposing pair of protuberances 34*a* and 34*b* and 36*a* and 36*b*, respectively, to create a ripple or corrugated-shaped passageway across each slot. It should be noted that a preferred material for the protective device is a molded plastic which has sufficient pliability or resilience to allow the blade of a broadhead arrow to be inserted therein, while providing frictional resistance against undesired movement of any portion of the arrowhead. The corresponding slots 15, 17, 18 and 19 include like structures.

Figure 7:
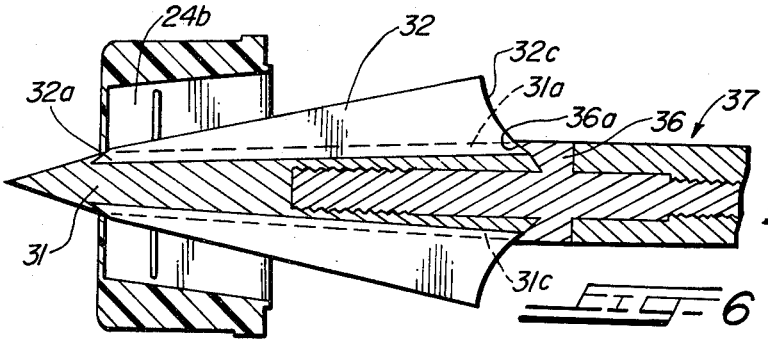
FIG. 7 is a cross-sectional view taken substantially along lines 7—7 of FIG. 1.

Referring to FIGS. 1 and 7, the combination of the tapered bore 21 and the annularly extending slots 24–29 in communication therewith define a hollow area adapted to receive a pointed spindle or head 31 and a plurality of blades 32–35 held thereon by a retainer 36, all combined to form the sharp end of a broadhead arrow, generally indicated at 37.

In operation, an arrowhead 31, with or without the blades 34–35, may be inserted in the central bore 21 of the protective device 10 until it frictionally engages the bore. As mentioned the ribbed outer surface 11*a* of the protective device 10 provides for each of fingertip manipulation of the protective device and the arrowhead 31. For example, the arrowhead 31 may be rotated very easily by finger manipulation of the outer ring. If it is intended that the blades be inserted into a blank head 31, the grooves 31*a*–31*d* (FIG. 7) in the arrowhead should be aligned with the proper slots in the protective device 10. An individual blade, such as shown at 32, may then be inserted in its proper slot, in this case slot 14, until the frontmost edge 32 thereof is received in the forwardmost portion of groove 31*a*. It should be noted as the blade 32 is inserted in slot 24, it is retained in the slot as soon as engagement is made with the bar-like protuberances 34*a*–*c*. After that frictional engagement is obtained, the individual blade 32 may be let loose by a user and the blade will remain in the protective device. Once the blade 32 is inserted fully in groove 31*a*, the combination protective device 10, head 31 and blade 32 may be rotated in a user's hand safely until the user orients the device so as to insert another blade in another groove. Once all of the blades are positioned in their respective grooves in the head 31, the device 10 and the head 31 and blades 32–35 may be rotated relative to the retainer 36 and the remainder of the arrow 37 until a leading edge 36*a* of a skirt on the retainer engages the trailing edge 32*c* of the blade 32 to lock all of the blades in their respective grooves simultaneously. In like manner, old or damaged blades may be removed from an arrowhead and replaced by new blades with safety when utilizing the device 10 of the invention. After all the blades are inserted or replaced in the head 31 and retained therein, the protective device 10 may be pulled off of the broadhead with a slight frictional force.

Figure 8:
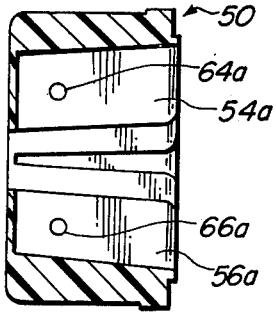
FIG. 8 is a cross-sectional view similar to FIG. 4 of a second embodiment of the present invention.
Figure 9:
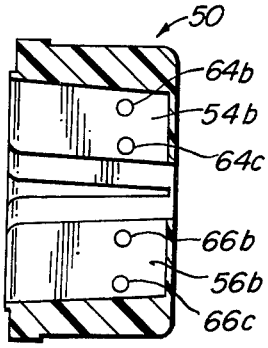
FIG. 9 is a cross-sectional view similar to FIG. 5 of the second embodiment of the present invention.

Referring to FIGS. 8 and 9, a second embodiment of the invention, generally indicated at 50, is constructed identically with the first embodiment 10, with the exception of the opposing slot side walls typically shown at 54*a*–*b* and 56*a*–*b* which include a plurality of detents (preferably cylindrical or hemispherical) 64*a*–*c* and 66*a*–*c* protruding therefrom. Similarly to the first embodiment, side walls 54*b*, 56*b* has a pair of spaced-apart detents 64*b*–*c* and 66*b*–*c*, respectively, protruding therefrom. The opposing side walls 54*a*, 56*a*, respectively, have a single protruding detent 64*a*, 66*a* respectively, which is positioned to extend between the dual detents on the opposing slot side wall. The combination of detents form a deformable frictional barrier which allows a blade to be movably positioned therein and yet frictionally retained thereby. The loading, replacing or removing of arrowhead blades in the second embodiment 50, is identical with that of the first embodiment 10.

Thus, a molded plastic spool-like protective device has been shown and described which allows an archer or other user to safely insert or replace razor-sharp blades in a broadhead arrow. The device is small, easily fits in a pocket or pouch, and may be carried by a user into the field. The molded plastic construction and small size enable the device to be inexpensively formed.

While two particular embodiments and variations of the invention have been shown and described, it will be obvious to those skilled in the art that changes and modifications may be made without departing from the invention in its broader aspects. Therefore, the aim in the appended claims is to cover all such changes and modifications as may fall within the true spirit and scope of the invention.

I claim:

1. A hand-held protective device to facilitate the safe loading of blade elements into an arrowhead, said device comprising a spool-like body formed with a principal central bore extending axially into said body, an array of spaced blade receiving slots formed in said body, said slots communicating with and extending radially from said central bore at selectable arcuate spacings from one another within the body of said device along the length of said bore, and the arcuate spacing of said slots being in correspondence with arcuate spacing of blade elements as secured in the head of an arrow, and a protuberance carried by a wall bounding each said slots, said protuberance extending into to invade said slot and terminating in a blade engaging surface for abutment against a face of a blade inserted into each of said slots, thereby frictionally to engage to secure the blades within said device during manipulation thereof.

2. A hand-held protective device to facilitate the safe loading of blade elements into an arrowhead, said device comprising a spool-like body formed with a principal central bore extending axially into said body, an array of spaced blade receiving slots formed in said body, said slots communicating with and extending radially from said central bore at selectable arcuate spacings from one another within the body of said device along the length of said bore, and the arcuate spacing of said slots being in correspondence with arcuate spacing of blade elements as secured in the head of an arrow, and protuberances carried by opposed bounding walls of each of said slots, said protuberances projecting into each of said slots and partially in the paths of blades inserted into said slots frictionally to engage the blades at contacted faces thereof.

3. The structure as set forth in claim 2 wherein said protuberances projecting into each of said slots on opposed walls thereof are displaced axially along each of said slots.

4. The structure as set forth in claim 2 wherein said protuberance is integrally formed with said wall bounding said one of said slots.

5. A hand-held protective device to facilitate the safe loading of blade elements into an arrowhead, said device comprising a spool-like body formed with a principal central bore extending axially into said body, an array of spaced blade receiving slots formed in said body, said slots communicating with and extending radially from said central bore at selectable arcuate spacings from one another within the body of said device along the length of said bore, and the arcuate spacing of said slots being in correspondence with arcuate spacing of blade elements as secured in the head of an arrow, and blade entry interference means in the path of insertion of a blade element into a slot of said device, for retaining said blade element in said slot, said blade entry interference means being carried by a wall bounding said slot and projecting into said slot and toward an opposed bounding wall thereof to provide a constricted zone in said slot in the path of entry of a blade element into said slot, said blade entry interference means adapted frictionally to abut against a blade at said contricted zone of said slot upon projection of said blade through said zone.

6. The structure as set forth in claim 5 wherein said blade entry interference means is formed integrally with a wall bounding said slot.

7. The structure as set forth in claim 4 wherein said bounding wall is generally planar and wherein said protuberance is a bar raised from a principal planar surface of said bounding wall and extending generally normally of a longitudinal axis of said central bore.

* * * * *